United States Patent [19]

Wahnschaff et al.

[11] 4,395,968

[45] Aug. 2, 1983

[54] CONTINUOUS FLOW GLUE POT FOR GLUE APPLICATOR

[76] Inventors: Paul Wahnschaff, 3202 Marjan Dr., Atlanta, Ga. 30340; Steven Wahnschaff, 190 Ansley Ct., Roswell, Ga. 30075; Michael J. Wahnschaff, 6851 Roswell Rd. A-10, Atlanta, Ga. 30328

[21] Appl. No.: 357,406

[22] Filed: Mar. 12, 1982

[51] Int. Cl.[3] ..... B05C 11/00

[52] U.S. Cl. ..... 118/602; 118/202; 118/203; 118/612; 126/284

[58] Field of Search ..... 118/202, 271, 203, 429, 118/302, 600, 602, 603, 612; 126/284, 377, 378, 343.5 A, 343.5 R; 222/146 H, 146 R; 239/139

[56] References Cited

U.S. PATENT DOCUMENTS 3,999,511 12/1976 Schwandt et al. ..... 118/259 X

FOREIGN PATENT DOCUMENTS 24637 1/1907 United Kingdom ..... 126/378

OTHER PUBLICATIONS

"Automatic 8½ Gallon Glue Tank w/Re-circulating and Wash Down System" p. B-3, FMC Corporation, Packaging Machinery Division, 200 Welsh Road, Horsham, Pa. 19044.

Blue Print Drawing of Model "501" Glue Tank Assem. For "405" Gluer FMC. Corporation, Packaging Machinery Division.

*Primary Examiner*—John P. McIntosh
*Assistant Examiner*—M. B. Calligaris
*Attorney, Agent, or Firm*—George M. Thomas

[57] ABSTRACT

The glue pot is attached to a glue applicator to supply a continuous flow of hot liquid glue to the applicator rolls of the glue applicator. The glue pot comprises an upright cylindrical glue container with an opening formed in the central portion of its bottom wall, and a water stack extending from said bottom wall opening upwardly through the glue container to form an annular glue reservoir. A water tank is positioned below the bottom wall of the glue container in open communication with the water stack, and water is supplied to the water tank and water stack. Heating means heats the water in the water tank and in the water stack, so that the glue in the glue reservoir is heated from inside out and from bottom up. A pump has its inlet in communication with the lower portion of the glue reservoir and it delivers liquid glue to the glue applicator rolls of the glue applicator, and directs a continuous flow of glue into the upper portion of the annular glue reservoir to continuously stir the glue in the reservoir. A water supply conduit extends through the heated water tank so as to supply hot water for cleaning the pump and glue conduits and for cleaning the glue applicator.

13 Claims, 2 Drawing Figures

CONTINUOUS FLOW GLUE POT FOR GLUE APPLICATOR

BACKGROUND OF THE INVENTION

This invention relates to glue applicators of the type that apply a film of glue to sheet material, such as to boxes or cartons, and more particularly to a glue pot for supplying a continuous stream of hot liquid glue to the applicator rolls of a glue applicator.

When glue is applied to sheet material, it is highly desirable to have the glue at a desired temperature and viscosity so that the glue can be spread easily and applied in an even coat to the sheet material. As the temperature of the glue is reduced, it becomes more viscous and eventually becomes hardened and unusable. When the operation of a glue applicator is terminated and the supply of glue is cut off, it is highly desirable to clean the glue applicator immediately after its operation has been terminated so as to remove the glue from the glue applicator. Otherwise, the temperature of the residual glue that remains in the glue applicator will drop, causing the glue to solidify and clog the working components of the equipment. Similarly, when a glue applicator is to be started up at the beginning of a work cycle, the glue must be heated in order that it change from a solid state to a liquid state so that the glue can be applied to the sheet material.

In the past, heated glue pots have been used to supply hot liquid glue to the applicator rolls of a glue applicator. The prior art glue pots include a double wall chamber that includes a main glue reservoir surrounded by a hot water reservoir. The glue is drawn from the lower portion of the glue reservoir and pumped through an insulated conduit to the applicator rolls of a glue applicator, and the excess glue from the glue applicator is drained back to the glue reservoir. Some of the problems experienced with the prior art glue pots are that the structure is expensive in that it requires a double wall container, the body of glue in the glue reservoir tends to form a film on the top of the glue, and a long time is required to heat the glue in the glue reservoir to the proper temperature and viscosity when the equipment is to be started at the beginning of a work cycle. Also, when additional glue is to be added to the glue reservoir, the additional glue, which usually is in solid form, tends to sink to the bottom of the glue reservoir and clog the inlet of the pump which draws the glue from the glue reservoir and delivers the glue to the glue applicator equipment.

SUMMARY OF THE INVENTION

Briefly described, the present invention comprises a continuous flow glue pot for use in combination with a glue applicator, for supplying liquid glue at a desired temperature and viscosity to the glue applicator. The glue pot comprises an upright cylindrical glue container with an outer cylindrical wall, a lid and a bottom wall, an opening formed in the central portion of the bottom wall, and a hot water stack extending from the bottom wall opening upwardly through the glue container toward the lid and forming with the glue container an annular glue reservoir. A water tank is positioned below the bottom wall of the glue container and is in free communication with the water stack. Heaters are located in the water tank for heating the water in the water tank and the water extending up through the water stack. A pump has its inlet in communication with the lower portion of the annular glue reservoir and its outlet delivers a flow of heated liquid glue to glue applicator rolls of a glue applicator, and to the upper portion of the glue reservoir to create a swirling movement of the liquid glue about the centrally located water stack.

An annular grate is positioned in the annular glue reservoir at an elevation above the bottom wall of the reservoir. Any solid glue chunks that are added to the glue in the glue reservoir will be restrained by the grate from moving to the lower portion of the glue reservoir until the solid chunks have been melted by the surrounding hot glue. A water supply conduit extends through the water tank, and has an inlet for connection to a source of water under pressure and a first outlet connected to the pump inlet and a second outlet for delivering heated water to the glue applicator for cleaning the glue applicator, and for delivering heated water to the water stack to fill the water stack.

Thus, it is an object of this invention to provide a continuous flow glue pot which provides a continuous supply of heated liquid glue to the applicator rolls of a glue applicator.

Another object of this invention is to provide a continuous flow glue pot which rapidly raises the temperature of glue to the desired temperature level, which provides means for expediently cleaning the glue applicator equipment and for purging itself of liquid glue, and which can receive solid chunks of glue without permitting the solid glue from being circulated from the glue reservoir to the glue applicator equipment.

Another object of this invention is to provide a self-cleaning continuous flow glue pot which is inexpensive to construct and to maintain, which is simple to operate, and which is reliable in its function.

Another object of this invention is to provide a continuous flow glue pot for supplying liquid glue to glue applicator equipment, wherein the glue is continuously stirred by recirculating the glue in the glue reservoir, and wherein moisture is continuously added to the glue in the glue reservoir.

Other objects, features and advantages of the present invention will become apparent upon reading the following specification, when taken in conjunction with the accompanying drawings.

DETAILED DESCRIPTION

Figure 1:
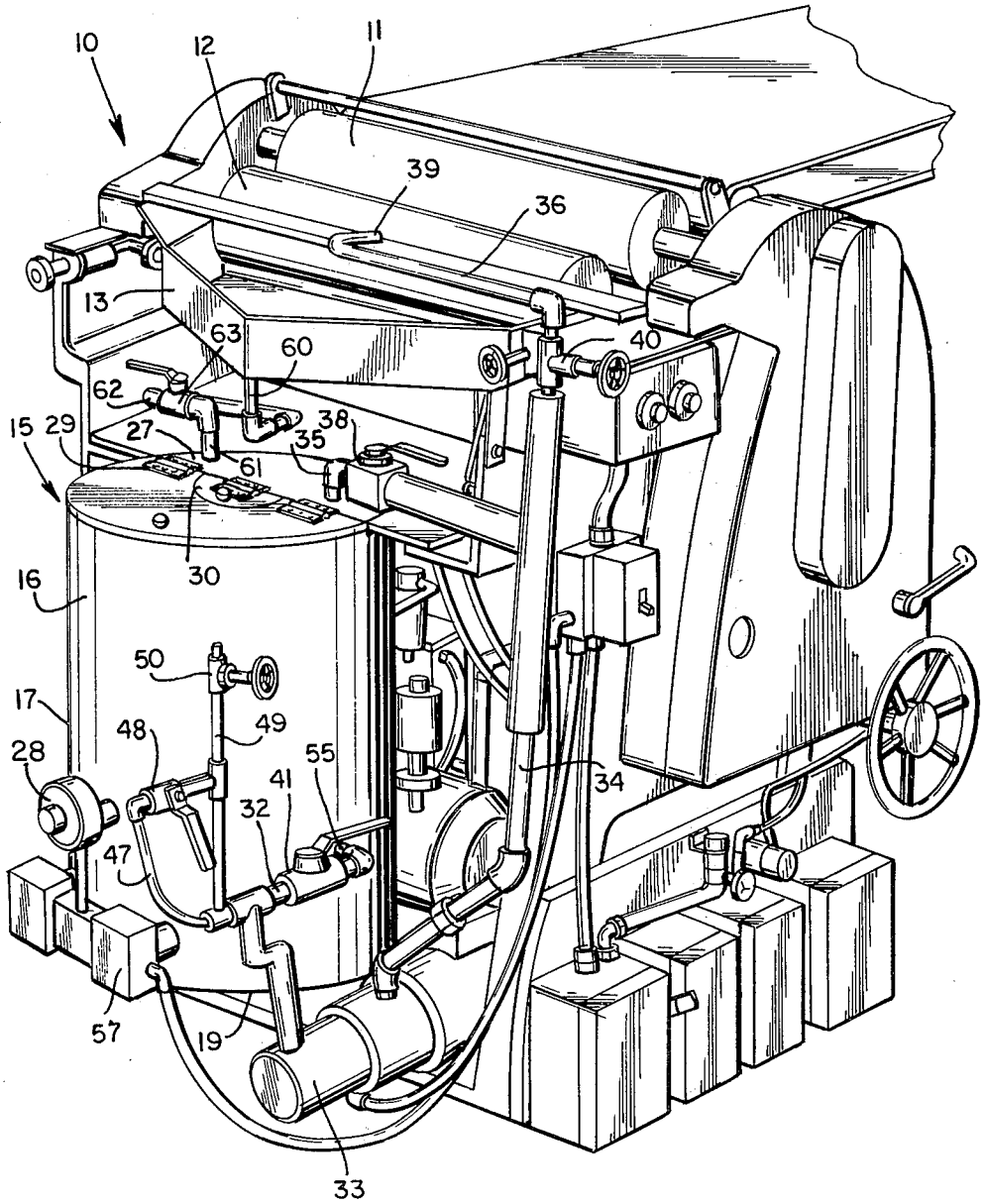
FIG. 1 is a perspective illustration of a glue applicator with the continous flow glue pot mounted thereto.

Referring now in more detail to the drawings, in which like numerals indicate like parts throughout the several views, FIG.1 shows a glue applicator 10 of the type utilized to apply a film of glue to sheet material, such as to pasteboard boxes. The glue applicator 10 includes a glue applicator roll 11 and a wetting roll 12. The wetting roll 12 is partially immersed in a body of liquid glue contained in glue pan 13. The sheet material is moved into contact with the glue applicator roll 11, and the glue is transferred from the pan 13 by wetting roll 12 to the applicator roll 11, to the sheet material. This function is also shown in U.S. Pat. Nos. 4,262,626 and 4,263,869.

Figure 2:
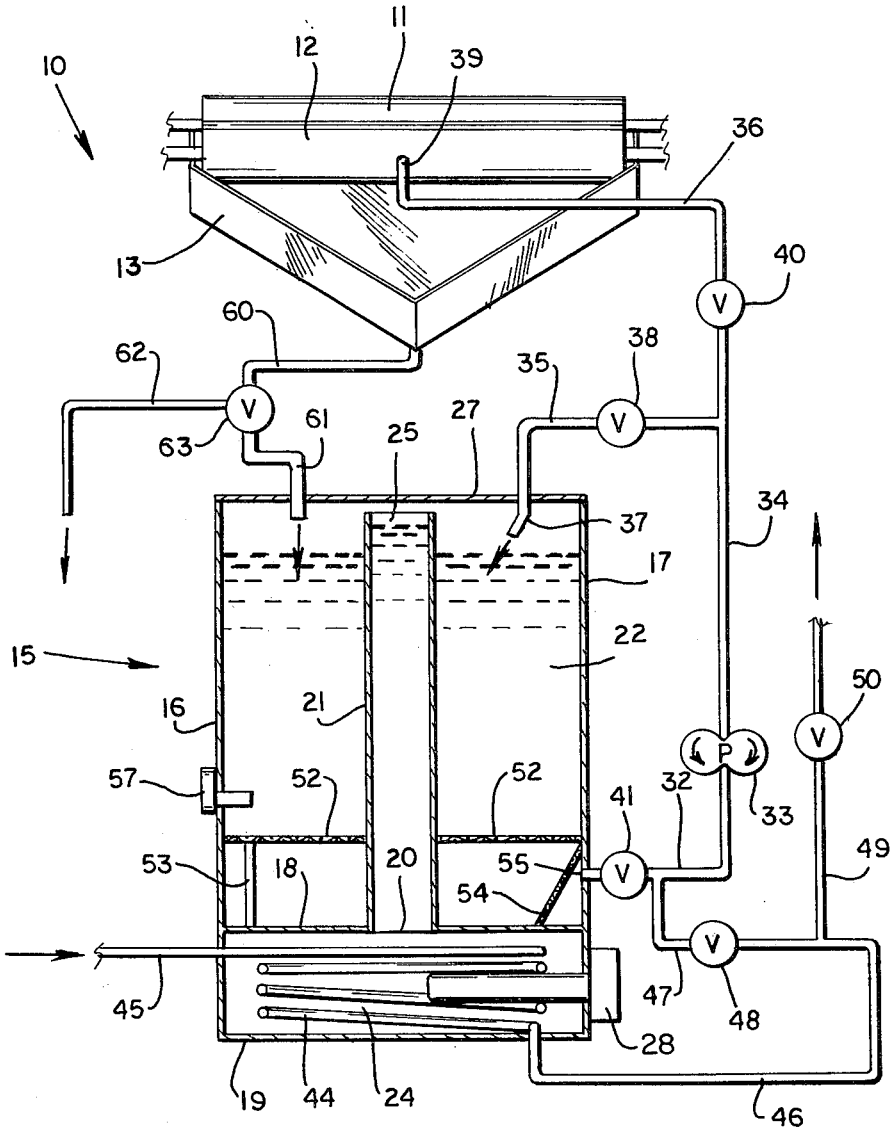
FIG. 2 is a schematic side elevational view of the continuous flow glue pot, illustrating how the liquid glue and the water is directed through the system.

As illustrated in FIG. 2, the continuous flow glue pot 15 is located below glue pan 13 of the glue applicator 10. Glue pot 15 comprises an upright cylindrical glue container 16 having an outer cylindrical wall 17, and internal bottom wall 18 and lower bottom wall 19. Opening 20 is centrally formed in the internal bottom wall 18, and water stack 21 extends from opening 20 upwardly through the glue container. The water stack 21 and the outer cylindrical wall 17 form an annular glue reservoir 22.

Lower bottom wall 19 and the lower portion of outer cylindrical wall 17 form a water tank 24 positioned below annular glue reservoir 22, with the internal bottom wall 18 forming the partition between water tank 24 and annular glue reservoir 22. The upper end 25 of water stack 21 is in open communication with annular glue reservoir 22. One or more water heaters 28 are mounted to water tank 24 with heating elements extending inwardly of the water tank and in heating relationship with respect to water inside the water tank. Two heaters are used in this embodiment of the invention, each comprises a two thousand watt submersible electric heater of conventional design.

A lid 27 is placed over the upper open end of cylindrical glue container 16. The bottom surface of lid 27 is spaced above the upper end 25 of the water stack 21, so that there is free communication between the interior of the water stack with the interior of the annular glue reservoir 22 about the water stack. The lid 27 is disk-shaped and is formed by two abutting halves with hinges 29 extending across its diameter, so as to form a butterfly lid. An additional lid leaf 30 is located centrally of one-half of the lid 27 over the upper end 25 of water stack 21. With this arrangement, lid leaf 30 can be pivoted up on its hinge 29 so as to expose the upper end 25 of water stack 21 without having to open the entire annular glue reservoir 22.

Glue supply conduit 32 communicates with the lower portion of glue reservoir 22 and with the inlet of pump 33. The outlet of pump 33 communicates with delivery conduit 34. Delivery conduit 34 includes a first branch conduit 35 and a second branch conduit 36. First branch conduit 35 extends into the upper portion of annular reservoir 22 through the stationary portion of butterfly lid 27, and its discharge end 37 is directed at an angle that slopes downwardly and about water stack 21. Valve 38 controls the flow of liquid through first branch conduit 35.

The discharge end 39 of second branch conduit 36 is directed toward glue applicator roll 12, and valve 40 controls the flow of liquid through second branch conduit 36. Valve 41 is located in glue supply conduit 42 and controls the flow of glue from annular glue reservoir 22 to the inlet of pump 33.

Water supply conduit 44 has an inlet end 45 which is connectable to a source of water under pressure, such as the municiple water service line. Water supply conduit 44 extends through water tank 24, with several spiral coils being formed in the water supply conduit within the water tank 24, so that the water moving through the water supply conduit is heated by the hot water in water tank 24. The outlet end 46 of water supply conduit 44 is connected to first branch conduit 47 through valve 48 to the glue supply conduit 32, and the second branch conduit 49 is controlled by valve 50.

Annular grate or screen 52 is located in annular glue reservoir 22 and extends about water stack 21. The annular screen is formed in two sections so that it can be easily inserted in and removed from the glue reservoir. Each section is supported in a parallel, spaced relationship above internal bottom wall 18 of glue container 16 by a plurality of legs 53. A secondary grate or screen 54 is formed over the outlet opening 55 of glue container 16 which communicates with glue supply conduit 52. A temperature indicator 57 extends through the outer cylindrical wall 17 of the glue container 16 so as to detect and indicate the temperature of the glue in the annular glue reservoir 22.

Drain conduit 60 is arranged to be connected to the lower portion of the glue pan 13 of the glue applicator 10. Drain conduit 60 includes first branch conduit 61 that extends through the stationary section of butterfly lid 27 and into the annular glue reservoir 22 for draining the glue from the glue pan to the glue reservoir. The second branch conduit 62 extends from drain conduit 60 to a remote delivery point. Valve 63 controls the direction of flow of liquid through drain conduit 60, so that the liquid flows either through the first branch conduit 61 or the second branch conduit 62.

When the glue pot is in operation, the water tank 24 and its water stack 21 are filled with water and heaters 28 are energized to heat the water. Glue is supplied to the annular glue reservoir 22 to the desired level. Preferably, the level of the water in the water tank and water stack is maintained at or slightly higher than the level of the glue in the annular glue reservoir. The hot water therefore heats the bottom and the interior of the glue reservoir and the glue present in the glue reservoir.

If the supply of liquid glue in the reservoir 22 is low, additional liquid or solid glue can be added, by raising the lid 27 and depositing the glue in the reservoir. If the glue is in a solid state, the glue tends to sink to the annular screen 52 which is located in spaced relationship above the internal bottom wall 18 of the glue container 16. The warmer liquid glue within the reservoir tends to heat the solid chunk of glue until the solid chunk of glue melts. The annular screen 52 prevents the solid glue from passing through the outlet opening 55 to the pump 33. Additionally, should any small particles of the solid glue manage to pass through the annular screen 52, the secondary screen 54, which has smaller openings, tends to trap the particles until they have dissipated.

Pump 33 draws the liquid glue from the lower portion of reservoir 22 and delivers the glue through glue delivery conduit 34 to the first and second branch conduits 35 and 36. Second branch conduit 36 is directed toward the glue wetting roll 12 to supply glue to the glue applicator. In the meantime, a larger volume of glue is directed through the first branch conduit 35 into the upper portion of glue reservoir 22. The discharge end 37 of branch conduit 35 directs the glue to one side of water stack 21 so as to form a swirling movement in the body of glue present in the annular reservoir 22, causing the glue to swirl about water stack 21. This tends to prevent a film or crust of glue from forming on the top surface of the body of glue in the reservoir, and no hot or cold spots are permitted to form by the moving glue. Additionally, the swirling liquid glue tends to move about any chunks of hard glue that may have been added to the body of glue, tending to heat and melt the solid glue.

The unused glue which is directed by the glue delivery conduit 34 to the glue applicator 10 tends to drain into glue pan 13, and then through drain conduit 60, its valve 63 and branch conduit 61 back to annular reservoir 22. This continuous movement of glue through the glue applicator 10 tends to avoid having the glue collect in the glue pan and become cold and solid.

The hot water present in water stack 21 tends to vaporize and the water vapor moves from the upper open end 25 of the water stack 21 beneath the lids 27 and 30 into the annular glue reservoir 22, so that moisture is continuously added from the water to the glue in the reservoir. This steam seepage tends to compensate for the moisture lost from the glue as the glue is recirculated in the system, keeping the moisture content of the glue constant. Also, the added moisture in the glue at the top of the body of glue in the annular glue reservoir tends to reduce the amount of foam that would otherwise form on the top of the glue in the reservoir. Should the glue in the reservoir become too thick, as by the addition of solid glue to the annular glue reservoir or because of evaporation of moisture from the recirculating glue, hot water can be added directly to the glue by opening water valve 48. The water is permitted by water valve 48 to move through water supply conduit 44 to the glue supply conduit 32 and to the inlet of pump 33, which adds water progressively and directly to the stream of glue moving to the glue applicator and moving to the upper portion of the reservoir.

When it is time for the work cycle of the glue applicator to be terminated, valve 41 in the glue supply conduit 32 is closed and valve 48 in the water supply conduit 44 is opened, and hot water from water supply conduit 44 is delivered to the inlet of pump 33. Pump 33 thereupon begins to flush the glue delivery conduit 34 and its branch conduits 35 and 36. The operator usually will permit the glue to be flushed through first branch conduit 35 until it is determined that all of the glue has been removed from the delivery conduit, whereupon the operator closes valve 38 so as to avoid delivering an excess of water to the glue in glue reservoir 22. In the meantime, the operator may adjust valve 40 so that the proper amount of water is delivered through the discharge end 39 of branch conduit 36 to the rolls 11 and 12 of glue applicator 10, thus tending to flush the liquid glue from the applicator rolls and the glue pan 13. The operator usually will watch the outlet of branch conduit 61 of drain conduit 60 to determine when the glue has been flushed from the drain conduit 60. When it is detected that the glue has been properly flushed from the drain conduit, the operator will turn valve 63 so that the water from the flushing operation is directed through second branch conduit 62 and is delivered to a drain (not shown).

When it is desired to flush other elements of the glue applicator 10 or the glue pot 15, a flexible hose is connected to second branch conduit 49 of water supply conduit 44, and valve 50 is opened so that hot water can be directed to the desired areas. Additionally, if it is desirable to fill water tank 24 and water stack 21, the flexible conduit can be inserted through the lid leaf 30 and down into the upper open end 25 of water stack 21, to supply water to the water tank and water stack.

While this invention has been described in detail with particular reference to a preferred embodiment thereof, it will be understood that variations and modifications can be effected within the spirit and scope of the invention as described hereinbefore and as defined in the appended claims.

We claim:

1. A glue pot for supplying liquid glue to the glue applicator rolls of a glue application system, said glue pot comprising an upright cylindrical glue container with an outer wall and a bottom wall, an opening formed in the central portion of said bottom wall, a water stack extending from said bottom wall opening upwardly through said glue container and forming with said glue container an annular glue reservoir, a glue outlet opening formed in the lower portion of said glue reservoir, a water tank positioned below the bottom wall of said glue container and in free communication with said water stack, heating means for heating the water in said water tank, pump means including an inlet and an outlet, water supply conduit means extending through said water tank and including an inlet for connection to a source of water under pressure and an outlet in communication with said pump inlet, a glue supply conduit in communication with said glue outlet opening and said pump inlet, valve means for selectively opening and closing communication between said water supply conduit and said pump means and for selectively opening and closing communication between said glue supply conduit and said pump means, and delivery conduit means connected to said pump outlet for directing glue to the upper portion of said annular glue reservoir and for directing glue to the glue applicator rolls of a glue application system, whereby glue is drawn by the pump means from the lower portion of said glue reservoir and directed through the delivery conduit to the glue applicator rolls and to the upper portion of the glue reservoir, and the heating means heats the water in the water tank and the water in the water tank and in the water stack heats the glue in the glue reservoir.

2. The glue pot of claim 1 and further including a screen means located in said glue reservoir in a position to prevent lumps of solid glue from passing from said glue reservoir through said glue outlet opening.

3. The glue pot of claim 1 and further including an annular screen means located in said glue reservoir and surrounding said water stack, means for supporting said annular screen means at a position above said glue outlet opening to prevent lumps of solid glue from passing from above said annular screen means through said glue outlet opening.

4. The glue pot of claim 1 and wherein said water supply conduit includes a branch conduit for directing water to said water stack to fill the water stack and to the glue application system to clean the glue application system.

5. The glue pot of claim 1 and wherein said delivery conduit means is connected to the upper portion of said annular glue reservoir at an angle to deliver glue in a circumferential direction about said water stack and to induce a swirling movement of liquid glue about said water stack.

6. The glue pot of claim 1 and further including drain conduit for connecting to the glue application system for directing glue from the glue application system to said reservoir.

7. The glue pot of claim 1 and wherein said cylindrical glue container and said water stack are open at their upper ends, and further including a lid for extending over said cylindrical glue container and said water stack, with the upper end portion of said water stack in open communication with said cylindrical glue container.

8. A glue pot for supplying liquid glue to the glue applicator rolls of a glue aplicaton system, said glue pot comprising an upright cylindrical glue container with a cylindrical side wall and a bottom wall, an upright stack centrally positioned in said cylindrical glue container and extending upwardly from said bottom wall to define with said cylindrical side wall an annular glue reservoir for containing glue, means for heating said bottom wall and said stack whereby heat is transferred from said bottom wall and said stack to glue in said glue reservoir, a pump and conduit means for withdrawing liquid glue from the lower portion of said glue reservoir and delivering glue to the glue applicator rolls of a glue application system including means for directing a flow of liquid glue into the upper portion of said glue reservoir in a direction to form a swirl of glue in said reservoir about said stack.

9. The glue pot of claim 8 and wherein said glue container further includes a liquid tank positioned beneath said glue reservoir with said bottom wall of said glue container forming a partition between said glue reservoir and said liquid tank, said liquid tank being in open communication with said stack, and wherein said means for heating said bottom wall and said stack comprises heating means for heating liquid contained in said liquid tank and extending up into said stack.

10. The glue pot of claim 8 and further including an annular screen means located in said glue reservoir and surrounding said stack, means for supporting said annular screen means at a position displaced above said bottom wall and above the lower portion of said glue reservoir from which liquid glue is withdrawn by said pump and conduit means, whereby solid glue is restrained from entering said pump and conduit means.

11. A glue pot for supplying liquid glue to the glue applicator rolls of a glue application system, said glue pot comprising a container with a bottom wall and a side wall, a stack centrally positioned in the container and extending upwardly from said bottom wall to define with said side wall an annular glue reservoir for containing glue, said stack being in open communication at its upper end with said reservoir, pump means having an inlet in communication with said reservoir for withdrawing glue from said reservoir and supplying glue to the glue applicator rolls, a liquid tank positioned beneath said container with the bottom wall of said glue container forming a partition between said liquid tank and said container, said liquid tank being in open communication with said stack, means for heating liquid in said liquid tank and in said stack, and conduit means for directing liquid from said liquid tank to the inlet of said pump.

12. A glue pot for supplying liquid glue to the glue applicator rolls of a glue application system, said glue pot comprising an upright cylindrical glue container with a cylindrical side wall and a bottom wall, an upright stack centrally positioned in said cylindrical glue container and extending upwardly from said bottom wall to define with said cylindrical side wall an annular glue reservoir for containing glue, heating means for heating said bottom wall and said stack whereby heat is transferred from said bottom wall and said stack to glue in said glue reservoir, a pump and conduit means for withdrawing liquid glue from the lower portion of said glue reservoir and delivering glue to the glue applicator rolls of a glue application system, a water supply conduit heated by said heating means and including an inlet for connection to a source of water under pressure and an outlet for communication with said pump and conduit means whereby water heated by the heating means can be directed to the pump and conduit means for cleaning glue from the pump and conduit means.

13. A glue pot for supplying liquid glue to the glue applicator rolls of a glue application system, said glue pot comprising a glue container with a side wall and a bottom wall, an upright stack centrally positioned in said glue container and extending upwardly from said bottom wall and including an open upper end portion within said glue container to define with said side wall an annular glue reservoir for containing glue, a liquid tank positioned beneath said glue reservoir with said bottom wall of said glue container forming a partition between said glue reservoir and said liquid tank, said liquid tank being in open communication with said stack whereby liquid fills the liquid tank and extends up into the stack, and heating means for heating the liquid contained in said liquid tank and extending up into said stack whereby heat is transferred from said bottom wall and said stack to glue in said glue reservoir and airborne moisture is transferable from the upper end of the stack to the glue reservoir, pump and conduit means for withdrawing liquid glue from the lower portion of said glue reservoir and delivering glue to the glue applicator rolls of a glue application system.

* * * * *